United States Patent [19]

Lachenmeier et al.

[11] 4,451,233

[45] * May 29, 1984

[54] APPARATUS FOR THE SHRINKING OF WRAPPING FOILS

[75] Inventors: Kurt Lachenmeier, Sønderborg; Peter Simonson, Graasten, both of Denmark

[73] Assignee: Kurt Lachenmeier ApS, Sonderborg, Denmark

[ * ] Notice: The portion of the term of this patent subsequent to May 18, 1999 has been disclaimed.

[21] Appl. No.: 359,248

[22] Filed: Mar. 18, 1982

Related U.S. Application Data

[63] Continuation of Ser. No. 131,838, Mar. 19, 1980, Pat. No. 4,330,265.

[30] Foreign Application Priority Data

Mar. 27, 1979 [DK] Denmark ..... 1233/79

[51] Int. Cl.³ ..... F23D 13/12; F24J 3/00

[52] U.S. Cl. ..... 432/224; 432/225; 53/557; 34/225

[58] Field of Search ..... 432/224, 225; 34/225, 34/233; 53/557

[56] References Cited

U.S. PATENT DOCUMENTS

| | | | |
|---|---|---|---|
| 1,956,519 | 4/1934 | Thomson | 432/225 |
| 3,222,800 | 12/1965 | Siegel et al. | 34/225 |
| 3,316,653 | 5/1967 | Zelnick | 34/225 |
| 3,616,548 | 11/1971 | Nichols | 34/233 |
| 3,711,957 | 1/1973 | Carver, Jr. | 34/223 |
| 3,833,338 | 9/1974 | Badrock | 432/225 |
| 3,963,417 | 6/1976 | Placek | 432/224 |
| 4,006,732 | 2/1977 | Schumm | 432/225 |
| 4,182,095 | 1/1980 | Day | 53/557 |
| 4,330,265 | 5/1982 | Lachenmeier et al. | 432/224 |

*Primary Examiner*—Henry C. Yuen

*Attorney, Agent, or Firm*—Burgess, Ryan & Wayne

[57] ABSTRACT

The invention relates to apparatus for the shrinking of foil, which is wrapped around an article, and comprises a frame 1, which along its inner edge is provided with a means of heating. The apparatus is characterized by the frame 1 being hollow, that there are means for blowing air into the hollow part, and means in the form of slots or ports 27 and 28 for leading the air out along the inner edge of the frame 1 close to the means of heating. The means of heating can, for example, consist of gas burners 20 or electric heating elements. The frame 1 can be arranged to move up and down around the article around which the foil is to be shrunk.

2 Claims, 4 Drawing Figures

Figure 1:
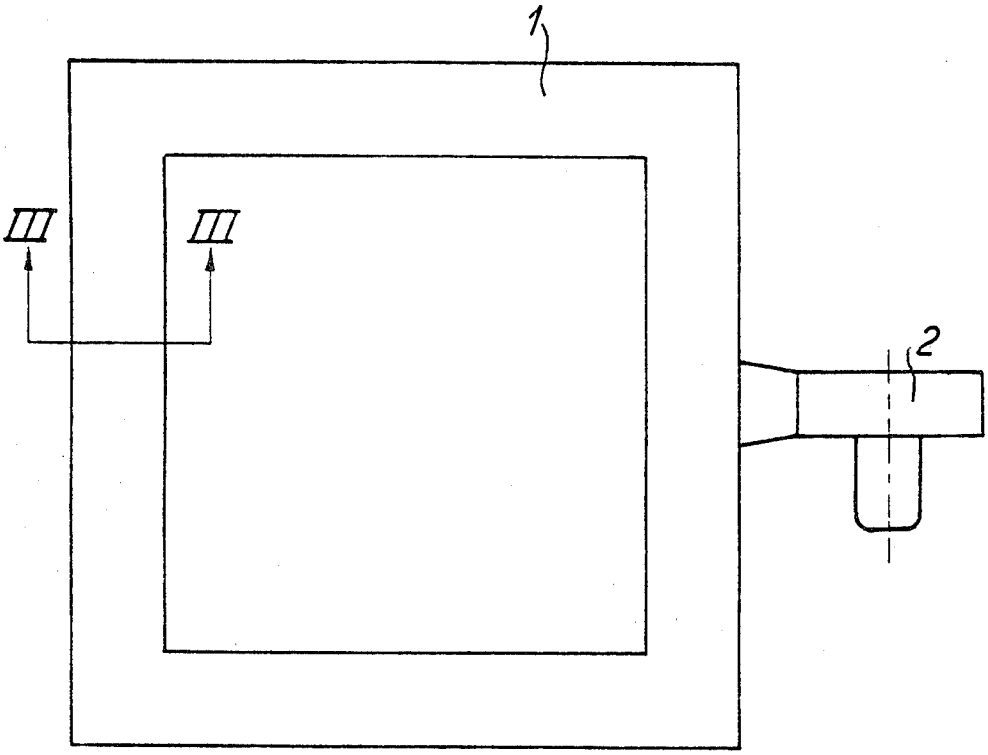

Fig. 3
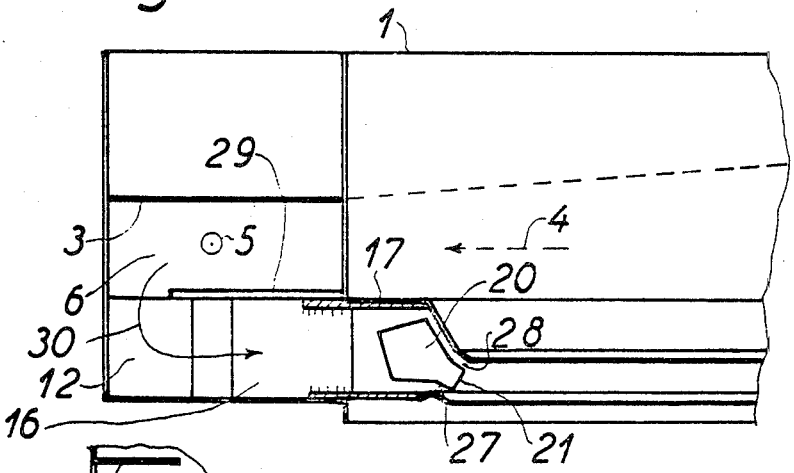
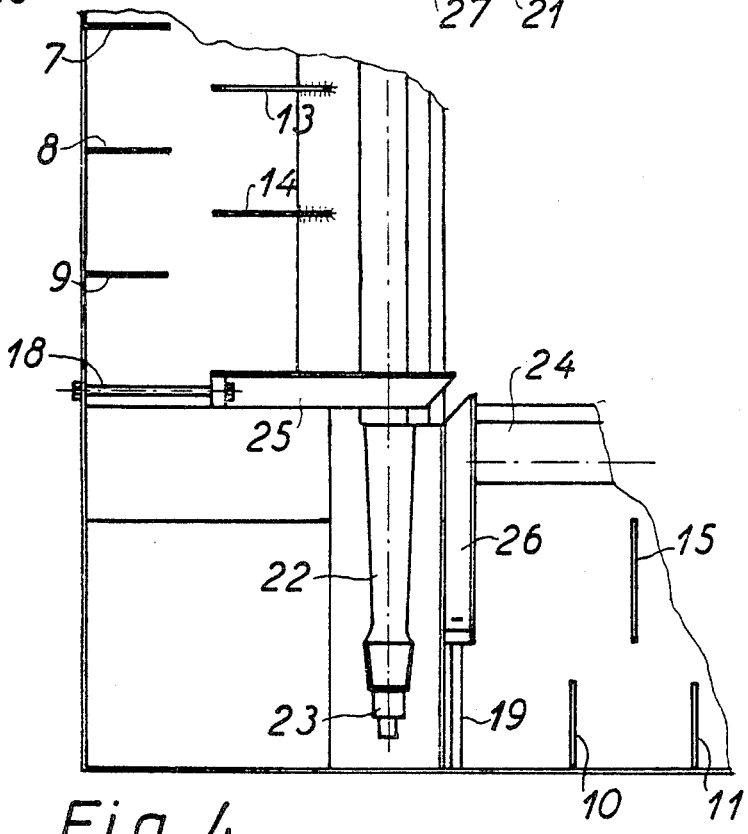
Fig. 4

APPARATUS FOR THE SHRINKING OF WRAPPING FOILS

This is a continuation of application Ser. No. 131,838, filed Mar. 19, 1980, U.S. Pat. No. 4,330,265.

This invention relates to apparatus for the shrinking of wrapping foil around an article, said apparatus comprising a frame or portal provided on its inner edge with a heating means.

Hitherto known apparatus of this kind has been provided with heating elements which have operated solely by means of infrared radiation. In order for this apparatus to function satisfactorily, it is necessary to maintain a precise distance between the heating elements and the foil to be shrunk. Therefore, in order to avoid the foil being scorched or not shrunk, it is necessary to ensure that the article to be wrapped is positioned very precisely in the apparatus.

The apparatus in accordance with this invention is characterized by said frame or portal being hollow, and that means are provided for blowing air into the hollow part, means for the uniform distribution of air along the extent of said hollow part, and means in the form of slots or ports for leading the air out along the inner edge close to the heating means.

This construction allows the air which is blown into said hollow frame or portal to be heated when it passes the heating means, thus providing the possibility of much better temperature control at greater distances from said heating means. Moreover, the temperature will not vary to any great degree depending on the distance from the heating means, and thus the positioning of the article to be wrapped in relation to the apparatus is far less critical.

The heating means can be electrical heating elements or other conceivable means, for example steam tubes. However, a preferred embodiment can be characterized by the heating means being comprised of cylindrical gas burner tubes, said burner tubes being arranged to blow gas out of a slot running along the inside of the frame or portal, and preferably so that the blow-out direction is turned away from the plane of said frame or protal.

This allows for the quick starting and stopping of the apparatus, and thus the saving of energy during idling periods.

A second embodiment can be characterized by the slots or openings for leading the air out along the inner edge consisting of two slots running along the inside face of the frame or portal, said slots being parallel and lying on each side of the outlet slot for the gas, thus considerably intensifying the effect already mentioned. The flame thus being confined between two air cushions greatly reduces the risk of the foil being damaged in the event of a spurt of flame.

Finally, when consisting of a frame or portal with upright sides, the apparatus can be characterized in that a cylindrical gas burner tube is mounted along each side and built into a drawer-like or telescopic part which also houses the two air discharge slots and, at right-angles to same, forerunning and equidistantly mounted follower plates for the air, the drawer-like or telescopic part being movable and adjustable in the plane of said frame or portal. The flexibility of the apparatus is thus further increased, in that it is possible for the apparatus to be adjusted to accommodate any given series of articles to be wrapped.

Figure 2:
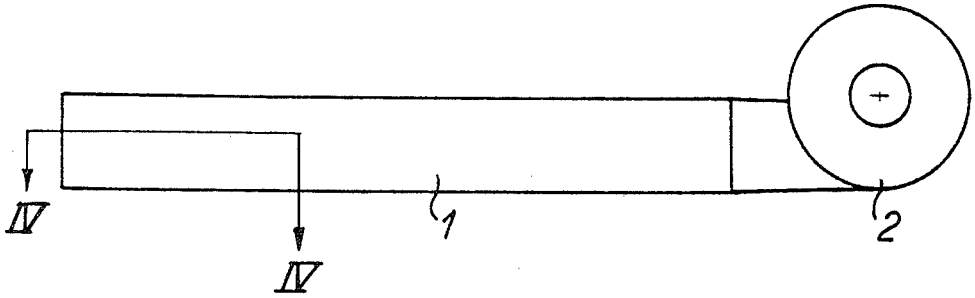

The invention will now be described in more detail with reference to the accompanying drawings, where FIG. 1 is a schematic arrangement of an embodiment of the apparatus according to this invention as seen from above, FIG. 2 shows the apparatus as seen from the side, FIG. 3 shows a section along the line III—III in FIG. 1, but on a larger scale, and FIG. 4 shows a section along the line IV—IV in FIG. 2, again on a larger scale.

In FIG. 1 is shown a horizontal, square and hollow frame 1, which is mounted vertically and adjustably on a column not shown. Said frame 1 can thus be moved up and down around a package not shown, but which is preferably box-shaped and having a cross-section in the horizontal plane which is smaller than the inner dimensions of the frame 1. On the frame 1 is mounted a blower 2, said blower being arranged to blow air into the hollow frame.

FIG. 3 shows a section of the frame 1 which is provided with a cover plate 3. The height of the cover plate 3 varies along the extent of the frame in such a way that the velocity of the air introduced by the blower 2 is held more or less constant, inasmuch as an outflow of air takes place along the whole of the inside face of the frame, and in a way as is described in the following.

The flow of air is shown by the arrows 4 and 5 (arrow 5 being at right angles to the plane of the paper). The chamber 6, into which the air flows, is rectangular along its whole extent, but its height varies because of the variation in the height of the cover plate 3 as already mentioned.

FIG. 4 can now be considered together with FIG. 3. Under the chamber 6 are mounted two sets of follower plates; an outer set consisting of the plates 7, 8, 9, 10, 11 and 12, and an inner set consisting of the plates 13, 14, 15 and 16. The outer set of follower plates are fixed firmly in the frame 1, while the inner set of follower plates are mounted in the drawer-like or telescopic part 17, which can be moved more in or more out of the frame 1, an adjustment which can be regulated by means of the regulating screws 18 and 19. The drawer-like or telescopic part 17 is also provided with a cylindrical gas burner tube 20 having an outflow port at the side 21, said outflow port running at right-angles to the plane of the paper. The gas burner tube 20 is supplied with gas through a mixing nozzle 22, in which air is mixed by ejector effect. The end 23 of the nozzle 22 is connected to a gas pipe not shown. FIG. 4 also shows a second gas burner tube 24 which extends over an adjacent side of the frame 1. The positioning of the gas burner tubes 20 and 24 is determined by the end pieces 25 and 26, only two of which are shown. The gas burner tube 20 is thus suspended in the drawer-like part 17 in such a waay that with its outflow port or slot in the side 21 it projects out of the drawer-like part, thus forming two air gaps 27 and 28, one on each side of the gas burner tube 20. The remaining gas burner tubes are constructed and arranged in the same manner. The drawer-like part 17 extending into the frame 1 is covered by a plate 29, said plate extending partly and transversely through the hollow frame 1.

The manner in which the apparatus functions will now be described, still with reference to the accompanying drawings.

The air flowing in, as shown by the arrows 4 and 5, is forced around the plate 29 as shown by the arrow 30. The outer set of follower plates, which can be assumed to create upright eddy currents at their upper horizontal edges, thus each catch an even amount of air from the air flowing into the space under the cover plate 3.

The inner set of follower plates even out the flow of air, which then flows further around the gas burner tube 20 and out through the slots 27 and 28. After out through the slots 27 and 28, the air will surround and cool the gas flame and thus naturally be heated. The direction of the outflow is turned 30° downwards from the horizontal, and the normal procedure when shrinking foil around an article being wrapped will be to start with the frame underneath and move it upwards at an even speed.

An important feature of the apparatus is that it can be started and stopped instantly.

In general it should be noted that although the explanation provided here relates to only one edge and one corner of the frame 1, the construction and arrangement follows the same pattern along all the inside edges of said frame. Furthermore, at each corner and at the inflow from the blower 2 there are mounted guide vanes in the hollow frame for turning the air current.

The apparatus according to this invention is not limited by the use of gas burner tubes. The same beneficial results can be achieved with other means of heating such as electricity or steam. An important detail of the preferred embodiment is that at least on one side of the warmest air flow, i.e. on that side which is nearest the foil when the current is turned away from the horizontal plane, there lies a cooling flow of blower air. It must be added that the cylindrical gas burners as described herein should not be understood to be solely circular cylindrical gas burner tubes. The burners concerned are called slatted or louver-type burners.

We claim:

1. Apparatus for shrinking heat-shrinkable foil around an article wrapped with said foil, said apparatus comprising:

a frame arranged to pass around an article wrapped with heat-shrinkable foil, said frame having hollow sides, each side having an elongated annular inwardly facing opening communicating with the interior of said side, each said opening having parallel elongated edges;

a gas burner tube suspended in the opening of each of said sides between the elongated parallel edges thereof, said tube extending along the corresponding side and having an elongated combustion gas exhaust port extending inwardly of said frame beyond said opening;

each said gas burner tube cooperating with the edges of the corresponding opening to define a pair of air outlet slots on opposite sides of said gas burner tube; and an air blower for (i) forcing air out of each of the air outlet slots in streams on opposite sides of each of the gas burner tubes, so that said air cools the corresponding gas burner tube, reduces the transmission of heat from said gas burner tube to said frame, envelops, intermixes with and is heated by the combustion gases excaping from the combustion gas exhaust port of said gas burner tube between and in communication with the air streams emanating from the slots on opposite sides of said gas burner tube, and for (ii) directing the heated air inwardly of said frame to impinge upon said heat-shrinkable foil.

2. The apparatus according to claim 1, wherein said air outlet slots are configured to direct air at an angle with respect to the central plane of said frame, said angle being substantially the same for all of said slots.

* * * * *